US009928771B2

(12) United States Patent
Cok

(10) Patent No.: US 9,928,771 B2
(45) Date of Patent: Mar. 27, 2018

(54) DISTRIBUTED PULSE WIDTH MODULATION CONTROL

(71) Applicant: X-Celeprint Limited, Cork (IE)

(72) Inventor: Ronald S. Cok, Rochester, NY (US)

(73) Assignee: X-Celeprint Limited, Cork (IE)

( * ) Notice: Subject to any disclaimer, the term of this patent is extended or adjusted under 35 U.S.C. 154(b) by 48 days.

(21) Appl. No.: 15/005,869

(22) Filed: Jan. 25, 2016

(65) Prior Publication Data

US 2017/0186356 A1 Jun. 29, 2017

Related U.S. Application Data

(60) Provisional application No. 62/387,544, filed on Dec. 24, 2015.

(51) Int. Cl.
*G09G 3/20* (2006.01)
*G09G 3/32* (2016.01)

(52) U.S. Cl.
CPC ..... *G09G 3/2014* (2013.01); *G09G 3/32* (2013.01)

(58) Field of Classification Search
None
See application file for complete search history.

(56) References Cited

U.S. PATENT DOCUMENTS 5,550,066 A 8/1996 Tang et al.
5,621,555 A 4/1997 Park
5,731,802 A 3/1998 Aras et al.
5,815,303 A 9/1998 Berlin
5,912,712 A 6/1999 Doherty
5,994,722 A 11/1999 Averbeck et al.
6,084,579 A 7/2000 Hirano
6,184,477 B1 2/2001 Tanahashi
6,278,242 B1 8/2001 Cok et al.
6,392,340 B2 5/2002 Yoneda et al.
6,448,718 B1 9/2002 Battersby
6,466,281 B1 10/2002 Huang et al.
(Continued)

FOREIGN PATENT DOCUMENTS

GB 2 496 183 A 5/2013
WO WO-2006/027730 A1 3/2006
(Continued)

OTHER PUBLICATIONS

Roscher, H., VCSEL Arrays with Redundant Pixel Designs for 10Gbits/s 2-D Space-Parallel MMF Transmission, Annual Report, optoelectronics Department, (2005).
(Continued)

*Primary Examiner* — Joseph Haley
*Assistant Examiner* — Emily Frank
(74) *Attorney, Agent, or Firm* — William R. Haulbrook; Alexander D. Augst; Choate, Hall & Stewart LLP

(57) ABSTRACT

A distributed pulse-width modulation system includes an array of pulse-width modulation elements, each element including a digital memory for storing a multi-bit digital value and a drive circuit that drives an output device in response to the multi-bit digital value stored in the digital memory. A system controller includes a memory for storing a multi-bit digital value for each element and a communication circuit for communicating each multi-bit digital value to each corresponding pulse-width modulation element.

15 Claims, 7 Drawing Sheets

(56) References Cited

U.S. PATENT DOCUMENTS 6,577,367 B2 6/2003 Kim
6,660,457 B1 12/2003 Imai et al.
6,717,560 B2 4/2004 Cok et al.
6,756,576 B1 6/2004 McElroy et al.
6,812,637 B2 11/2004 Cok et al.
6,933,532 B2 8/2005 Arnold et al.
7,012,382 B2 3/2006 Cheang et al.
7,091,523 B2 8/2006 Cok et al.
7,129,457 B2 10/2006 McElroy et al.
7,195,733 B2 3/2007 Rogers et al.
7,288,753 B2 10/2007 Cok
7,402,951 B2 7/2008 Cok
7,420,221 B2 9/2008 Nagai
7,466,075 B2 12/2008 Cok et al.
7,521,292 B2 4/2009 Rogers et al.
7,557,367 B2 7/2009 Rogers et al.
7,586,497 B2 9/2009 Boroson et al.
7,622,367 B1 11/2009 Nuzzo et al.
7,662,545 B2 2/2010 Nuzzo et al.
7,687,812 B2 3/2010 Louwsma et al.
7,704,684 B2 4/2010 Rogers et al.
7,738,001 B2 6/2010 Routley et al.
7,791,271 B2 9/2010 Cok et al.
7,799,699 B2 9/2010 Nuzzo et al.
7,816,856 B2 10/2010 Cok et al.
7,834,541 B2 11/2010 Cok
7,893,612 B2 2/2011 Cok
7,919,342 B2 4/2011 Cok
7,927,976 B2 4/2011 Menard
7,932,123 B2 4/2011 Rogers et al.
7,943,491 B2 5/2011 Nuzzo et al.
7,969,085 B2 6/2011 Cok
7,972,875 B2 7/2011 Rogers et al.
7,982,296 B2 7/2011 Nuzzo et al.
7,990,058 B2 8/2011 Cok et al.
7,999,454 B2 8/2011 Winters et al.
8,029,139 B2 10/2011 Ellinger et al.
8,039,847 B2 10/2011 Nuzzo et al.
8,198,621 B2 6/2012 Rogers et al.
8,207,547 B2 6/2012 Lin
8,207,635 B2 6/2012 Covaro
8,243,027 B2 8/2012 Hotelling et al.
8,261,660 B2 9/2012 Menard
8,334,545 B2 12/2012 Levermore et al.
8,394,706 B2 3/2013 Nuzzo et al.
8,421,791 B2 4/2013 Harada
8,440,546 B2 5/2013 Nuzzo et al.
8,450,927 B2 5/2013 Lenk et al.
8,470,701 B2 6/2013 Rogers et al.
8,502,192 B2 8/2013 Kwak et al.
8,506,867 B2 8/2013 Menard
8,664,699 B2 3/2014 Nuzzo et al.
8,686,447 B2 4/2014 Tomoda et al.
8,722,458 B2 5/2014 Rogers et al.
8,754,396 B2 6/2014 Rogers et al.
8,766,970 B2 7/2014 Chien et al.
8,791,474 B1 7/2014 Bibl et al.
8,794,501 B2 8/2014 Bibl et al.
8,803,857 B2 8/2014 Cok
8,817,369 B2 8/2014 Daiku
8,854,294 B2 10/2014 Sakariya
8,877,648 B2 11/2014 Bower et al.
8,889,485 B2 11/2014 Bower
8,895,406 B2 11/2014 Rogers et al.
8,987,765 B2 3/2015 Bibl et al.
9,153,171 B2 10/2015 Sakariya et al.
9,202,996 B2 12/2015 Orsley et al.
9,626,908 B2 4/2017 Sakariya et al.
2001/0022564 A1 9/2001 Youngquist et al.
2002/0096994 A1 7/2002 Iwafuchi et al.
2003/0189829 A1 10/2003 Shimizu et al.
2003/0223275 A1 12/2003 Abe
2004/0212296 A1 10/2004 Nakamura et al.
2004/0227704 A1 11/2004 Wang et al.
2004/0252933 A1 12/2004 Sylvester et al.
2005/0012076 A1 1/2005 Morioka
2005/0116621 A1 6/2005 Bellmann et al.
2005/0140275 A1 6/2005 Park
2005/0168987 A1 8/2005 Tamaoki et al.
2005/0275615 A1 12/2005 Kahen et al.
2006/0063309 A1 3/2006 Sugiyama et al.
2007/0035340 A1 2/2007 Kimura
2007/0077349 A1 4/2007 Newman et al.
2007/0201056 A1 8/2007 Cok et al.
2008/0180381 A1 7/2008 Jeong et al.
2008/0259019 A1* 10/2008 Ng ..... G09G 3/2014 345/98
2009/0147033 A1 6/2009 Arai et al.
2009/0273303 A1 11/2009 Peng
2009/0315054 A1 12/2009 Kim et al.
2010/0045690 A1 2/2010 Handschy et al.
2010/0078670 A1 4/2010 Kim et al.
2010/0085295 A1 4/2010 Zhao et al.
2010/0214247 A1 8/2010 Tang et al.
2010/0248484 A1 9/2010 Bower et al.
2010/0258710 A1 10/2010 Wiese et al.
2010/0317132 A1 12/2010 Rogers et al.
2011/0084993 A1 4/2011 Kawabe
2011/0199011 A1 8/2011 Nakazawa
2011/0211348 A1 9/2011 Kim
2012/0126229 A1 5/2012 Bower
2012/0228669 A1 9/2012 Bower et al.
2012/0314388 A1 12/2012 Bower et al.
2013/0015483 A1 1/2013 Shimokawa et al.
2013/0069275 A1 3/2013 Menard et al.
2013/0088416 A1 4/2013 Smith et al.
2013/0141469 A1 6/2013 Xu
2013/0153277 A1 6/2013 Menard et al.
2013/0196474 A1 8/2013 Meitl et al.
2013/0207964 A1 8/2013 Fleck et al.
2013/0221355 A1 8/2013 Bower et al.
2013/0273695 A1 10/2013 Menard et al.
2014/0055654 A1 2/2014 Borthakur et al.
2014/0104243 A1 4/2014 Sakariya et al.
2014/0184667 A1 7/2014 Xu
2014/0217448 A1 8/2014 Kim et al.
2014/0264763 A1 9/2014 Meitl et al.
2014/0267683 A1 9/2014 Bibl et al.
2014/0306248 A1 10/2014 Ahn et al.
2014/0367633 A1 12/2014 Bibl et al.
2015/0135525 A1 5/2015 Bower
2015/0137153 A1 5/2015 Bibl et al.
2015/0169011 A1 6/2015 Bibl et al.
2015/0181148 A1 6/2015 Slovick et al.
2015/0263066 A1 9/2015 Hu et al.
2015/0280066 A1 10/2015 Fujimura et al.
2015/0280089 A1 10/2015 Obata et al.
2015/0302795 A1 10/2015 Genoe
2015/0371585 A1 12/2015 Bower et al.
2015/0371974 A1 12/2015 Bower et al.
2015/0372051 A1 12/2015 Bower et al.
2015/0372052 A1 12/2015 Bower et al.
2015/0372053 A1 12/2015 Bower et al.
2015/0373793 A1 12/2015 Bower et al.
2016/0005721 A1 1/2016 Bower et al.
2016/0018094 A1 1/2016 Bower et al.
2016/0064363 A1 3/2016 Bower et al.
2016/0093600 A1 3/2016 Bower et al.
2016/0119565 A1 4/2016 Fujita et al.
2016/0127668 A1 5/2016 Fujita et al.
2016/0163253 A1* 6/2016 Chaji ..... G09G 3/2011 345/691
2016/0212361 A1 7/2016 Suzuki
2016/0343771 A1 11/2016 Bower et al.
2017/0040371 A1 2/2017 Izuhara
2017/0047393 A1 2/2017 Bower et al.
2017/0061867 A1 3/2017 Cok et al.
2017/0154819 A1 6/2017 Bower et al.
2017/0187976 A1 6/2017 Cok
2017/0188427 A1 6/2017 Cok et al.
2017/0206820 A1 7/2017 Cok et al.
2017/0206845 A1 7/2017 Sakariya et al.

(56) References Cited

U.S. PATENT DOCUMENTS

| | | | |
|---|---|---|---|
| 2017/0330509 | A1 | 11/2017 | Cok et al. |
| 2017/0352647 | A1 | 12/2017 | Raymond et al. |

FOREIGN PATENT DOCUMENTS

| | | | |
|---|---|---|---|
| WO | WO-2006/099741 | A1 | 9/2006 |
| WO | WO-2008/103931 | A2 | 8/2008 |
| WO | WO-2010/032603 | A1 | 3/2010 |
| WO | WO-2010/111601 | A2 | 9/2010 |
| WO | WO-2010/132552 | A1 | 11/2010 |
| WO | WO-2013/064800 | A1 | 5/2013 |
| WO | WO-2013/165124 | A1 | 11/2013 |
| WO | WO-2014/121635 | A1 | 8/2014 |
| WO | WO-2014/149864 | A1 | 9/2014 |

OTHER PUBLICATIONS

Yaniv et al., A 640 × 480 Pixel Computer Display Using Pin Diodes with Device Redundancy, 1988 International Display Research Conference, IEEE, CH-2678-1/88:152-154 (1988).

Cok, R. S. et al., AMOLED displays with transfer-printed integrated circuits, Journal of SID 19/(4):335-341(2011).

Hamer et al., 63.2: AMOLED Displays Using Transfer-Printed Integrated Circuits, SID 09 Digest, 40(2):947-950 (2009).

Lee, S. H. etal, Laser Lift-Offof GaN Thin Film and its Application to the Flexible Light Emitting Diodes, Proc. of SPIE 8460:846011-1-846011-6 (2012).

* cited by examiner

DISTRIBUTED PULSE WIDTH MODULATION CONTROL

RELATED APPLICATIONS

This application claims priority to and the benefit of U.S. Provisional Patent Application No. 62/387,544, filed Dec. 24, 2015, titled Distributed Pulse Width Modulation Control, the contents of which are incorporated by reference herein in its entirety.

Reference is made to commonly assigned U.S. patent application Ser. No. 14/835,282 entitled Bit-Plane Pulse Width Modulated Digital Display System by Cok et al, the disclosure of which is incorporated herein by reference in its entirety.

FIELD OF THE INVENTION

The present invention relates to systems using digital values driven by pulse-width modulation.

BACKGROUND OF THE INVENTION

Flat-panel displays are widely used in conjunction with computing devices, in portable devices, and for entertainment devices such as televisions. Such displays typically employ a plurality of pixels distributed over a display substrate to display images, graphics, or text. In a color display, each pixel includes light emitters that emit light of different colors, such as red, green, and blue. For example, liquid crystal displays (LCDs) employ liquid crystals to block or transmit light from a backlight behind the liquid crystals and organic light-emitting diode (OLED) displays rely on passing current through a layer of organic material that glows in response to the current. Displays using inorganic light emitting diodes (LEDs) are also in widespread use for outdoor signage and have been demonstrated in a 55-inch television.

Displays are typically controlled with either a passive-matrix (PM) control employing electronic circuitry external to the display substrate or an active-matrix (AM) control employing electronic circuitry formed directly on the display substrate and associated with each light-emitting element. Both OLED displays and LCDs using passive-matrix control and active-matrix control are available. An example of such an AM OLED display device is disclosed in U.S. Pat. No. 5,550,066.

Active-matrix circuits are commonly constructed with thin-film transistors (TFTs) in a semiconductor layer formed over a display substrate and employing a separate TFT circuit to control each light-emitting pixel in the display. The semiconductor layer is typically amorphous silicon or polycrystalline silicon and is distributed over the entire flat-panel display substrate. The semiconductor layer is photolithographically processed to form electronic control elements, such as transistors and capacitors. Additional layers, for example, insulating dielectric layers and conductive metal layers are provided, often by evaporation or sputtering, and photolithographically patterned to form electrical interconnections, or wires.

Typically, each display sub-pixel is controlled by one control element, and each control element includes at least one transistor. For example, in a simple active-matrix organic light-emitting diode (OLED) display, each control element includes two transistors (a select transistor and a power transistor) and one capacitor for storing a charge specifying the luminance of the sub-pixel. Each OLED element employs an independent control electrode connected to the power transistor and a common electrode. In contrast, an LCD typically uses a single transistor to control each pixel. Control of the light-emitting elements is usually provided through a data signal line, a select signal line, a power connection and a ground connection. Active-matrix elements are not necessarily limited to displays and can be distributed over a substrate and employed in other applications requiring spatially distributed control.

Liquid crystals are readily controlled by a voltage applied to the single control transistor. In contrast, the light output from both organic and inorganic LEDs is a function of the current that passes through the LEDs. The light output by an LED is generally linear in response to current but is very non-linear in response to voltage. Thus, in order to provide a well-controlled LED, it is preferred to use a current-controlled circuit to drive each of the individual LEDs in a display. Furthermore, inorganic LEDs typically have variable efficiency at different current, voltage, or luminance levels. It is therefore more efficient to drive the inorganic LED with a particular desired constant current.

Pulse width modulation (PWM) schemes control luminance by varying the time during which a constant current is supplied to a light emitter. A fast response to a pulse is desirable to control the current and provide good temporal resolution for the light emitter. However, capacitance and inductance inherent in circuitry on a light-emitter substrate can reduce the frequency with which pulses can be applied to a light emitter. This problem is sometimes addressed by using pre-charge current pulses on the leading edge of the driving waveform and a discharge pulse on the trailing edge of the waveform. However, this increases power consumption in the system and can, for example, consume approximately half of the total power for controlling the light emitters.

Pulse-width modulation is used to provide dimming for light-emissive devices such as back-light units in liquid crystal displays. For example, U.S. Patent Publication No. 20080180381 describes a display apparatus with a PWM dimming control function in which the brightness of groups of LEDs in a backlight are controlled to provide local dimming and thereby improve the contrast of the LCD.

OLED displays are also known to include PWM control, for example, as taught in U.S. Patent Publication No. 20110084993. In this design, a storage capacitor is used to store the data value desired for display at the pixel. A variable-length control signal for controlling a drive transistor with a constant current is formed by a difference between the analog data value and a triangular wave form. However, this design requires a large circuit and six control signals, limiting the display resolution for a thin-film transistor backplane.

U.S. Pat. No. 7,738,001 describes a passive-matrix control method for OLED displays. By comparing a data value to a counter in a row or column driver, a binary control signal indicates when the pixel in the corresponding row or column should be turned on. This approach requires a counter and comparison circuit for each pixel in a row or column and is only feasible for passive-matrix displays. U.S. Pat. No. 5,731,802 describes a passive-matrix control method for displays. However, large passive-matrix displays can suffer from flicker.

U.S. Pat. No. 5,912,712 discloses a method for expanding a pulse width modulation sequence to adapt to varying video frame times by controlling a clock signal. This design does not use pulse width modulation for controlling a display pixel.

There remains a need, therefore, for an active-matrix display system that provides an efficient, constant current drive signal to a light emitter and has a high resolution.

SUMMARY OF THE INVENTION

The present invention is, among various embodiments, a system incorporating a plurality of distributed elements, each incorporating a multi-bit pulse-width modulation circuit for independently providing multi-bit pulse-width modulation control to each element. In one embodiment, the system is a digital-drive display system or, more succinctly, a digital display. An array of elements such as display pixels is arranged, for example on a display substrate. Each element includes an output device, such as a light emitter, a digital memory for storing a multi-bit digital value, such as a pixel value, and a drive circuit that drives the output device in response to the multi-bit digital value. The drive circuit can provide a voltage or a current in response to the value of the multi-bit digital value. The drive circuit can provide a constant current source that is supplied to the output device for a time period corresponding to the multi-bit digital value.

Constant current sources are useful for driving light-emitting diodes (LEDs) because LEDs typically are most efficient within a limited range of currents so that a temporally varied constant current drive is more efficient than a variable current drive or variable voltage drive. However, conventional schemes for providing temporal control, for example pulse width modulation (PWM), are generally employed in passive-matrix displays which suffer from flicker and are therefore limited to relatively small displays. A prior-art constant-current drive used in an OLED active-matrix display requires analog storage and complex control schemes with relatively large circuits and many control signals to provide a temporal control, limiting the density of pixels on a display substrate.

The present invention addresses these limitations by providing digital storage for a multi-bit digital value at each element location. Digital storage is not practical for conventional flat-panel displays that use thin-film transistors because the thin-film circuits required for digital pixel value storage are much too large to achieve desirable display resolution. However, according to the present invention, small micro transfer printed integrated circuits (chiplets) having a crystalline semiconductor substrate can provide small, high-performance digital pixel value storage circuits and temporally controlled constant-current LED drive circuits in a digital display with practical resolution. Such a display has excellent resolution because the chiplets are very small, has excellent efficiency by using constant-current drive for LEDs, and has reduced flicker by using a high-frequency active-matrix control structure.

In further embodiments of the present invention, display pixels are repeatedly loaded with different multi-bit digital values making up a full-bit digital value to provide arbitrary bit depth and gray-scale resolution. Control signals provided by a system controller enables output devices such as micro-light-emitting diodes in each element for a period corresponding to the multi-bit digital values loaded into the array of elements.

In one embodiment of the present invention, a distributed pulse-width modulation system comprises:

an array of pulse-width modulation elements, each element including a digital memory for storing a multi-bit digital value and a drive circuit that drives an output device in response to the multi-bit digital value stored in the digital memory;

a system controller including a memory for storing a multi-bit digital value for each element and a communication circuit for communicating each multi-bit digital value to each corresponding pulse-width modulation element.

In an embodiment, the present invention is a distributed pulse-width modulation system because pulse-width modulation elements in the array are spatially distributed over a substrate and each provided an independent pulse-width modulation control to the output device in the element. Each element can store a different multi-bit digital value and each output device in the element in the array can independently output the different multi-bit digital value, so that each element has a different output.

In another embodiment, a pixel circuit for a digital display system comprises a digital memory for storing a multi-bit digital value and a drive circuit that drives a light emitter in response to the multi-bit digital value stored in the digital memory.

In yet another embodiment, a method of controlling a distributed pulse-width modulation system comprises:

providing an array of multi-bit digital values;

loading each element of the array of elements with a multi-bit digital value of the array of multi-bit digital values;

providing a timing signal to each element;

combining the timing signal and the multi-bit digital value to provide a temporally controlled signal in each element, the temporally controlled signal responsive to the value of the multi-bit digital value; and driving the output device of each element in response to the temporally controlled signal.

BRIEF DESCRIPTION OF THE DRAWINGS

The foregoing and other objects, aspects, features, and advantages of the present disclosure will become more apparent and better understood by referring to the following description taken in conjunction with the accompanying drawings, in which.

Figure 1:
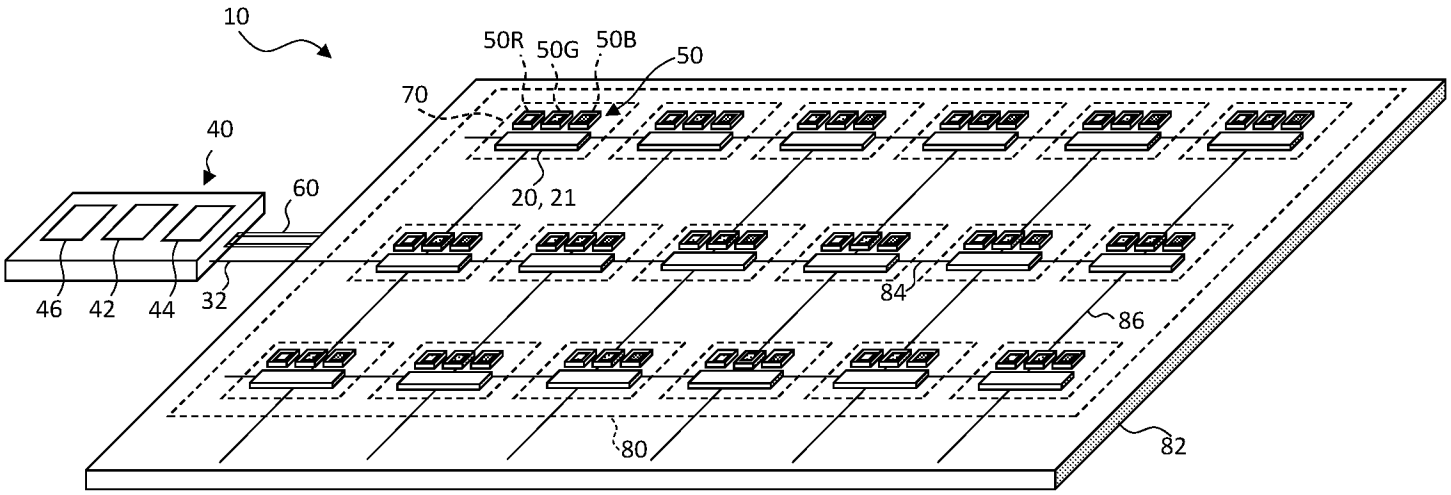
FIG. 1 is a schematic perspective of an embodiment of the present invention.

The features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. The figures are not drawn to scale since the variation in size of various elements in the Figures is too great to permit depiction to scale.

DETAILED DESCRIPTION OF THE INVENTION

Figure 2:
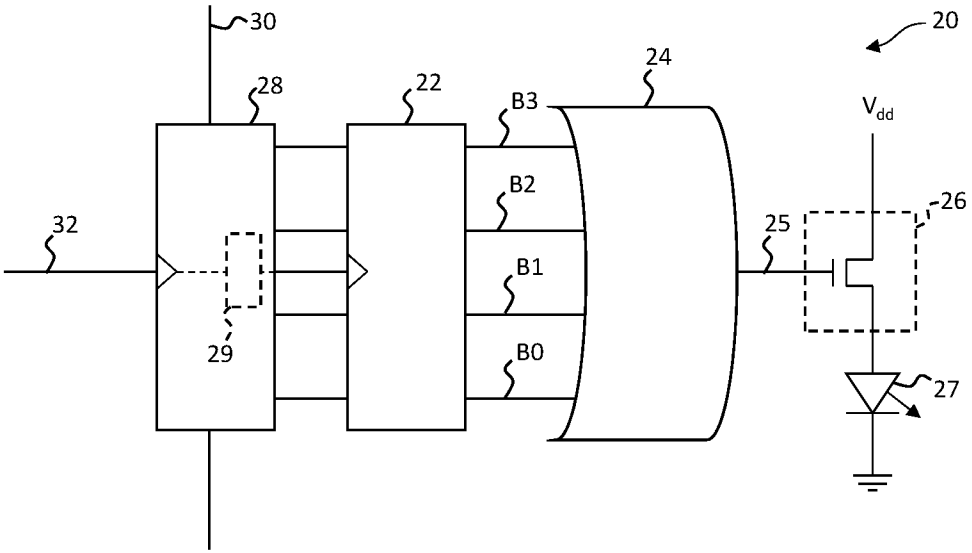
FIG. 2 is a schematic diagram of an element of the embodiment of FIG. 1.

Referring to the perspective illustration of FIG. 1 and the corresponding detailed schematic of FIG. 2, according to an embodiment of the present invention, a distributed pulse-width modulation system 10 includes an array of pulse-width modulation elements 20. In an embodiment, the array of pulse-width modulation elements 20 is spatially distributed over a system substrate 82 in rows and columns. Each element 20 includes a digital memory 28 for storing a multi-bit digital value and a drive circuit 26 that drives an output device 27 in response to the multi-bit digital value stored in the digital memory 28. A system controller 40 includes a memory 42 for storing a multi-bit digital value for each element 20 and a communication circuit 44 for communicating each multi-bit digital value to each corresponding pulse-width modulation element 20, for example, through a bus 60 electrically connecting the system controller 40 to the elements 20.

The system controller 40 can be, for example, an integrated circuit including the memory 42, such as a static or dynamic memory, and the communication circuit 44 can be a logic circuit with output drivers (such as transistors) providing signals on output wires connected, for example, to the bus 60 connected to the system substrate 82 and to row lines 84 and column lines 86 to provide active-matrix-addressed control to the array of elements 20. For example, the electrical connections on the system substrate 82 can be electrically conductive wires. For clarity, the electrical connections between the bus 60 and the row lines 84 and column lines 86 are not shown.

The element 20 can be, for example, an integrated circuit including the digital memory 28 and the drive circuit 26 can be an analog or digital or mixed-signal circuit with output drivers (such as transistors) controlling the output device 27. The element 20 can be provided in a bare die, unpackaged integrated circuit, or discrete components and can be mounted on the system substrate 82 using micro-transfer printing.

The distributed pulse-width modulation system 10 can be a display system, the output device 27 can be a light emitter, for example, a light-emitting diode (LED) such as an inorganic micro-light-emitting diode, and the system controller 40 can be a display controller. The elements 20 can be pixels and the multi-bit digital values can be pixel values specifying light output from the LEDs. The elements 20 can form an array of elements 20 arranged in rows and columns on the system substrate 82 to form a display. As illustrated in FIG. 1, three elements 20 are included in a common integrated circuit chiplet 21 (also indicated as a common element 20). Each of the elements 20 in the chiplet 21 includes a different output device 27. Each different output device is an inorganic micro-light emitter that emits a different color of light. In the FIG. 1 embodiment, the output devices 27 are a red light emitter 50R that emits red light, a green light emitter 50G that emits green light, and a blue light emitter 50B that emits blue light. Taken together the light emitters 50 and elements 20 provide a full-color pixel 70. The full-color pixel includes three elements 20 (one for each color of light emitter 50). As used herein, a pixel includes a single output device 27. As shown in FIG. 1, the three elements 20 are provided in a single integrated circuit, for example a small chiplet 21 such as a bare die. In other embodiments, each element 20 can be a separate integrated circuit chiplet 21 or can be provided in discrete components (not shown).

The system controller 40 provides a multi-bit digital value to each element 20. This can be done in any of a variety of ways. In the embodiment illustrated in FIG. 1, the system controller 40 serially shifts a sequence of multi-bit digital values through each of a series of elements 20 arranged in a row with a common clock signal 32. Multiple rows of elements 20 can be loaded at the same time or at different times. In other embodiments, the elements 20 can be accessed using matrix addressing and the multi-bit digital values can be provided in parallel rather than as a serial bit stream. In such cases, the digital memory 28 can have a parallel data input control rather than the serial input control illustrated in FIG. 2. Other logical designs can be used.

Referring specifically to FIG. 2, the digital memory 28 of the element 20 is a serial shift register that receives multi-bit digital values through a serial input 30 attached to the bus 60 (FIG. 1). The serial input 30 can be a row line 84 or column line 86. The multi-bit digital values are clocked into the digital memory 28 with the common clock signal 32. The stored multi-bit digital values are loaded into a down counter 22, for example, using a digital logic circuit 29. (The down counter 22 can also be a digital memory 28.) The logic circuit 29 can also provide the clock signal 32 to the down counter 22 after the multi-bit digital value is loaded to cause the down counter 22 to decrement. The logic circuit 29, the digital memory 28, and the down counter 22 can be a common circuit, separate circuits, or any combination of circuits. The multi-bit digital value can have any number of bits greater than one. In various embodiments, the multi-bit digital value is a 2-bit value, a 3-bit value, a 4-bit value, a 6-bit value, or an 8-bit value. In the FIG. 2 example, the multi-bit digital value has four bits and the down counter 22 is a 4-bit counter. The down counter 22 counts down to zero when supplied with the clock signal 32 or a signal derived from the clock signal 32 and maintains a zero output thereafter, even if additional clock signals 32 or derived clock signals are provided. Thus, the down counter can count at a frequency different from the clock rate at which the multi-bit-digital values are loaded into the digital memory 28 so that the multi-bit digital values can be loaded at a higher rate than the down counter 22 counts down. A cycle counter is provided, for example, in the logic circuit 29 to clock the down counter 22 at least a number of times equal to $2^n$ (two raised to the power of n) where n is the number of bits in the multi-bit digital value. An OR logic circuit 24 receives the bits B0, B1, B2, and B3 output by the down counter 22 and provides an output enable signal 25 as long as the down counter 22 has a non-zero value. The enable signal 25 controls a drive circuit 26 (in this example connected to the gate of a drive transistor) that drives an output device 27 (in this example an LED). Other logic circuits can provide the functionality described in FIG. 2. FIG. 2 is only one example of a logic circuit useful for the present invention. Various portions of the circuits described can be integrated into a common circuit or divided into separate circuits or can be implemented according to different designs. For example, the digital memory/serial shift register 28 and down counter 22 can be combined into a single universal counter and are illustrated as separate elements for descriptive clarity.

Figure 7:
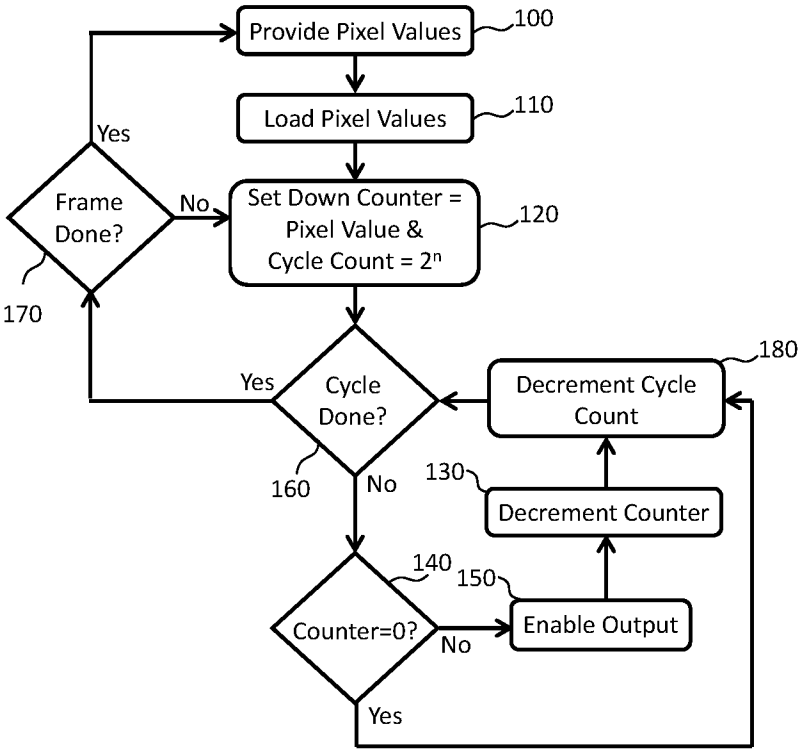
FIGS. 7-8 are flow diagrams illustrating methods of the present invention.

Referring also to FIG. 7, according to an embodiment of the present invention, a method of operating the distributed pulse-width modulation system 10 of the present invention includes first providing multi-bit digital value; for example, pixel values from an image frame of an image sequence, to the system controller 40 and storing the multi-bit digital values in the memory 42 of the system controller 40 in step 100. Each pixel value is a multi-bit digital value specifying a desired luminance output over a period of time by the output device 27 of each element 20. Thus, in an embodiment, each element 20 corresponds to a pixel and is spatially located on the system substrate 82 in correspondence with the relative location of the pixel provided to the element 20 in the image so that the array of elements 20 forms a display for displaying the pixel values of the image. The multi-bit digital pixel values are loaded into the corresponding elements 20 by the system controller 40 in step 110 and the down counter 22 is set to the loaded multi-bit digital value in step 120. A cycle controller is also set to the value 2n, where n is the number of bits in the multi-bit digital value. The cycle state is tested in step 160. If the cycle is done (cycle counter=0), the frame state is tested in step 170. If the frame is done, a new set of multi-bit digital values from the image sequence is loaded and the process starts over (step 100). If the frame is not done the output cycle is repeated (step 120).

If the cycle is not done (i.e., the cycle counter is not zero), the down counter 22 value is tested in step 140 and, if it is not zero, the output is enabled in step 150, the down counter 22 is decremented in step 130 (if it is not already zero), and the cycle counter is decremented in step 180, responsive to the clock signal 32. The test process is then repeated by testing the cycle state in step 160. If the counter value is zero, the cycle counter is decremented in step 180 and the test process is repeated by testing the cycle state in step 160. The time required to count down the cycle counter can be less than a frame time period (e.g., to reduce flicker).

In an embodiment, the system controller 40 includes a timing circuit 46 (FIG. 1) for providing timing signals to each element 20. The time period can be formed with a counter controlled by the timing signal. Alternatively, the element 20 can include a timing circuit (for example in logic circuit 29) to provide a derived clock signal used by the down counter 22. The timing signals can control the rate at which the output device 27 is driven in response to the multi-bit digital value stored in the digital memory 28 and can be different from the rate at which data is loaded into the array of elements 20. For example, the multi-bit digital values can be loaded at a 1 MHz rate. The least-significant bit of the multi-bit digital value can correspond to a 1 msec time period and the clock signal 32 (or derived clock signal) can have a corresponding 1 msec period so that the down counter 22 decrements at a 1 kHz frequency. Therefore, the output device 27 can be enabled for any time period from zero to 15 msecs depending on the multi-bit digital value provided to the down counter 22. Thus, the element 20 provides a pulse-width modulation of the output device 27. Any frequency compatible with the element 20 hardware can be provided by the system controller 40 so that different pulse rates can be used according to the desired application of the distributed pulse-width modulation system 10, for example 10 kHz or 100 kHz.

Pulse-width modulation is usefully employed with light-emitting diodes, since light-emitting diodes tend to have an optimum current and voltage operating parameter at which the LED performance is optimal for some operating characteristic, for example efficiency. Thus, it is an advantage in some applications to provide a constant power to the output device 27 and to modulate the output device 27 output using temporal modulation, such as pulse-width modulation, to provide variable output over a period of time greater than the minimum pulse width period, for example to provide variable luminance. Thus, in an embodiment, the drive circuit 26 provides a voltage or a current corresponding for a portion of a time period corresponding to the value of the multi-bit digital value and provides a constant current or voltage that is supplied to the output device 27 for that time period.

According to a further embodiment of the present invention, different clock rates are provided to the elements 20 to provide different operating time periods corresponding to different portions of a single digital value. In such an embodiment, the system controller 40 includes a memory 42 for storing a full-bit digital value for each element 20. The full-bit digital value includes a plurality of multi-bit digital values, and the communication circuit 44 communicates each multi-bit digital value to each corresponding element 20 sequentially. The full-bit digital value is the desired output value for the output devices 27 over a period of time, for example, a frame period. For example, a full-bit digital value can be an 8-bit value having values ranging from zero to 255 and representing a range of luminance values from minimum luminance at zero to maximum luminance at 255 (i.e., from off to maximum brightness). If the multi-bit value loaded into the elements 20 has the same number of bits as the full-bit digital value, a pulse-width modulation function is provided as described above with respect to FIG. 2 and FIG. 7.

However, in other embodiments, the digital memory 28 and the down counter 22 in the elements 20 have fewer bits than the full-bit pixel value. For example, the full-bit digital value can be 8 bits but the digital memory 28 and the down counter 22 in the elements 20 can store only 4 bits. In this case, the multi-bit digital value (the value that is loaded into the elements 20) is only 4 bits so that the full-bit digital value (having 8 bits) includes a plurality (two) of multi-bit digital values (of four bits each). In another example, the multi-bit digital value (the value that is loaded into the elements 20) is only 2 bits so that the full-bit digital value (having 8 bits) includes a plurality (four) of multi-bit digital values (of two bits each). It is not necessary that every multi-bit digital value have the same number of bits, so long as the digital memory 28 is sufficiently large for the bits in the largest multi-bit digital value. For example, if the full-bit digital value has 8 bits, the multi-bit values can be two bits, three bits, and three bits. The number of bits in each of the multi-bit digital values of a full-bit digital value must sum to the number of bits in the full-bit digital value. A full-bit digital value can be divided in different ways into different numbers of different multi-bit digital values. For example, if the full-bit digital value has 12 bits, the multi-bit values can include six two-bit multi-bit digital values, four three-bit multi-bit digital values, three four-bit multi-bit digital values, or six two-bit multi-bit digital values. In another example, if the full-bit digital value has 12 bits, the multi-bit values can include one three-bit multi-bit digital values, one five-bit multi-bit digital values, and one four-bit multi-bit digital values.

In a conventional binary numbering system as used by computer scientists, the bits in a number are labeled B0, B1, B2, and so on corresponding to the place of the bit in the binary number and arranged sequentially from left to right in a graphic numerical depiction. Each successive place to the right represents a value twice that of the previous place to the left. B0 is typically designated the least significant bit and has a place value of one. B1 is the next bit and has a place value twice that of B0, in this case two, and B2 has a place value twice that of B1, in this case four. Thus, the nth bit has a place value equal to $2^n$ and is conventionally designated as B(n−1). The different multi-bit digital values making up a full-bit digital value therefore have different relative values depending on their relative places in the full-bit digital value. The least significant bit of each multi-bit digital value will have a value $2^n$, where n is the place of the least significant bit of the multi-bit digital value. For example, if the full-bit digital value has 8 bits and is made up of a first four-bit multi-bit digital value corresponding to the first lower four bits of the full-bit digital value (B0, B1, B2, B3), the second four-bit multi-bit digital values corresponding to the second upper four bits of the full-bit digital value (B4, B5, B6, B7) have a value $2^4$ (equal to 16) greater than the first four-bit multi-bit digital value.

In a pulse-width modulated system, the values represent portions of a time period where the maximum value is equivalent to the maximum time period and the minimum value (typically zero) is equal to the minimum time period, typically zero time. One bit in the value is the minimum change and is chosen to correspond to the desired minimum change in the chosen time period. Thus, each multi-bit digital value in a full-bit digital value has a minimum period value corresponding to its least significant bit value. For example, in an 8-bit full-bit digital value system with two four-bit multi-bit values and where each bit in the value corresponds to one-msec, each of the first four-bit multi-bit digital values (corresponding to bits B0, B1, B2, B3 of the full-bit digital value) represents a one-msec time period. However, each of the second four-bit multi-bit digital values (corresponding to bits B4, B5, B6, B7 of the full-bit digital value) represent a period equal to $2^n$ where n=4 so that the period represented by each value of the second four-bit multi-bit digital value is 16×one-msec or 16 msecs.

Figure 3:
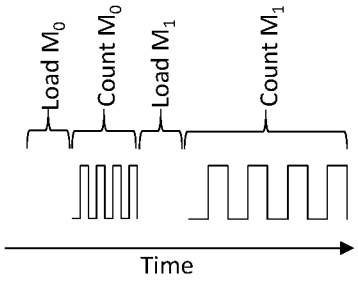
FIGS. 3-5 are timing diagrams illustrating the operation of various embodiments of the present invention.
Figure 4:
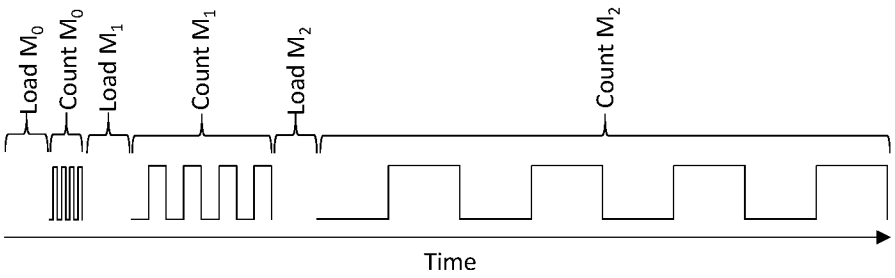
Figure 5:
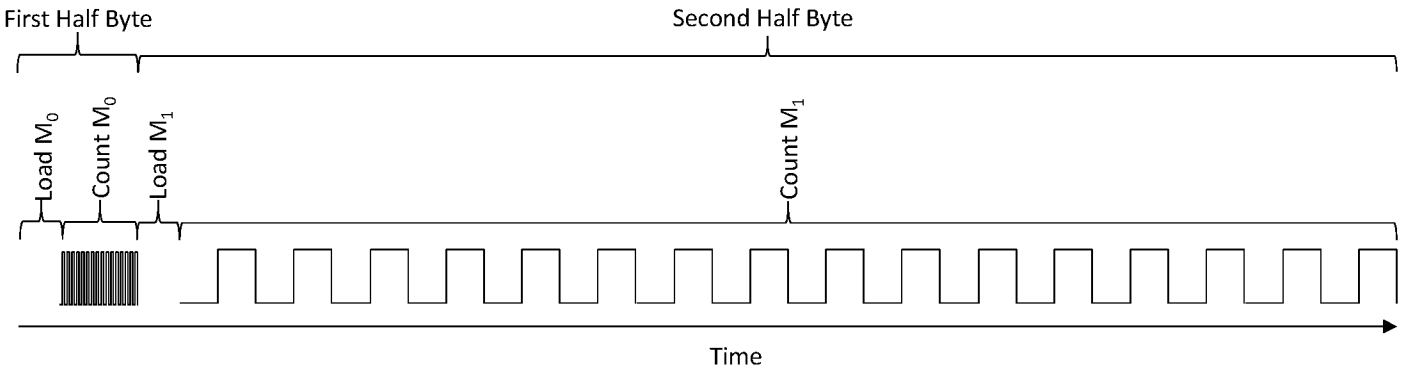

FIGS. 3, 4, and 5 illustrate three different examples of multi-bit digital values making up a full-bit digital value applied to a distributed pulse-width-modulated system 10 of the present invention. Referring to FIG. 3, a full-bit digital value has four bits made up of two two-bit multi-bit digital values. As shown, the first multi-bit digital values are supplied by the system controller 40 and loaded into the respective elements 20 during the Load $M_0$ time period (corresponding to steps 100, 110, and 120 of FIG. 7). The clock signal 32 is then supplied for four cycles (equal to $2^n$ where n is the number of bits in the first multi-bit digital value, two in this example) to cause the down counter 22 and cycle counter to decrement, and if the output of the down counter 22 is non-zero, the output device 27 is enabled (corresponding to steps 130, 140, 150, and 160 of FIG. 7) during the Count $M_0$ time period. The second multi-bit digital values are then supplied by the system controller 40 and loaded into the respective elements 20 during the Load $M_1$ time period (corresponding to steps 100, 110, and 120 of FIG. 7). The clock signal 32 is then supplied for 4 cycles (equal to $2^n$ where n is the number of bits in the second multi-bit digital value, 2 in this example) to cause the down counter 22 and cycle counter to decrement during the Count $M_1$ time period. If the output of the down counter 22 is non-zero, the output device 27 is enabled. However, for the second multi-bit digital value cycle, as shown in FIG. 3 the clock rate has a period equal to four times the period of the clock used for the first multi-bit digital value because the least significant bit of the second multi-bit digital value is the second bit B2 and four is equal to $2^n$ where n equals 2, the place of the least significant bit of the second multi-bit digital value.

Referring to FIG. 4, a full-bit digital value has six bits made up of three two-bit multi-bit digital values. As shown, the first multi-bit digital values are supplied by the system controller 40 and loaded into the respective elements 20 during the Load $M_0$ time period (corresponding to steps 100, 110, and 120 of FIG. 7). The clock signal 32 is then supplied for 4 cycles (equal to $2^n$ where n is the number of bits in the first multi-bit digital value, 2 in this example) to cause the down counter 22 and cycle counter to decrement, and if the output of the down counter 22 is non-zero, the output device 27 is enabled (corresponding to steps 130, 140, 150, and 160 of FIG. 7) during the Count $M_0$ time period. The second multi-bit digital values are then supplied by the system controller 40 and loaded into the respective elements 20 during the Load $M_1$ time period. The clock signal 32 is then supplied for 4 cycles (equal to $2^n$ where n is the number of bits in the second multi-bit digital value, 2 in this example) to cause the down counter 22 and cycle counter to decrement during the Count $M_1$ time period. If the output of the down counter 22 is non-zero, the output device 27 is enabled. However, for the second multi-bit digital value cycle, the clock rate has a period equal to four times the period of the clock used for the first multi-bit digital value because the least significant bit of the second multi-bit digital value is the second bit B2 and four is equal to $2^n$ where n equals 2, the place of the least significant bit of the second multi-bit digital value. The third multi-bit digital values are then supplied by the system controller 40 and loaded into the respective elements 20 during the Load $M_2$ time period. The clock signal 32 is then supplied for 4 cycles (equal to $2^n$ where n is the number of bits in the third multi-bit digital value, 2 in this example) to cause the down counter 22 and cycle counter to decrement during the Count $M_2$ time period. If the output of the down counter 22 is non-zero, the output device 27 is enabled. However, for the third multi-bit digital value cycle, the clock rate has a period equal to 16 times the period of the clock used for the first multi-bit digital value because the least significant bit of the second multi-bit digital value is the fourth bit B4 and 16 is equal to $2^n$ where n equals 4, the place of the least significant bit of the third multi-bit digital value.

Referring to FIG. 5, a full-bit digital value has eight bits made up of two four-bit multi-bit digital values. As shown, the first multi-bit digital values are supplied by the system controller 40 and loaded into the respective elements 20 during the Load $M_0$ time period (corresponding to steps 100, 110, and 120 of FIG. 7). The clock signal 32 is then supplied for 16 cycles (equal to $2^n$ where n is the number of bits in the first multi-bit digital value, 4 in this example) to cause the down counter 22 and cycle counter to decrement during the Count $M_0$ time period, and if the output of the down counter 22 is non-zero, the output device 27 is enabled (corresponding to steps 130, 140, 150, and 160 of FIG. 7). The second multi-bit digital values are then supplied by the system controller 40 and loaded into the respective elements 20 during the Load $M_1$ time period (corresponding to steps 100, 110, and 120 of FIG. 7). The clock signal 32 is then supplied for 16 cycles (equal to $2^n$ where n is the number of bits in the second multi-bit digital value, 4 in this example) to cause the down counter 22 and cycle counter to decrement during the Count $M_1$ time period. If the output of the down counter 22 is non-zero, the output device 27 is enabled. However, for the second multi-bit digital value cycle, the clock rate has a period equal to 16 times the period of the clock used for the first multi-bit digital value because the least significant bit of the second multi-bit digital value is the fourth bit B2 and 16 is equal to $2^n$ where n equals 4, the place of the least significant bit of the second multi-bit digital value.

Thus, the first multi-bit digital value has a clock signal 32 with a first period and the second multi-bit digital value has a clock signal 32 with a second period that is related to the first period by the relative values of the lower bits and the upper bits in the full-bit digital value. In an embodiment, the second period has a length that is $2^n$ times the first period wherein n is the place value of the least significant bit in the second multi-bit digital value. During the counting period for each multi-bit digital value, the period of the clock signal 32 can be set by the timing circuit 46 of the system controller 40. Alternatively, the period of the clock signal 32 can be determined by the logic circuit 29, for example, by providing a frequency divider for the clock signal 32 used to drive the cycle counter and the down counter 22. Note that the clock signal 32 used to load data into the elements 20 can have a different frequency, for example much higher than the counting frequency to reduce the time spent loading data into the elements 20.

Figure 8:
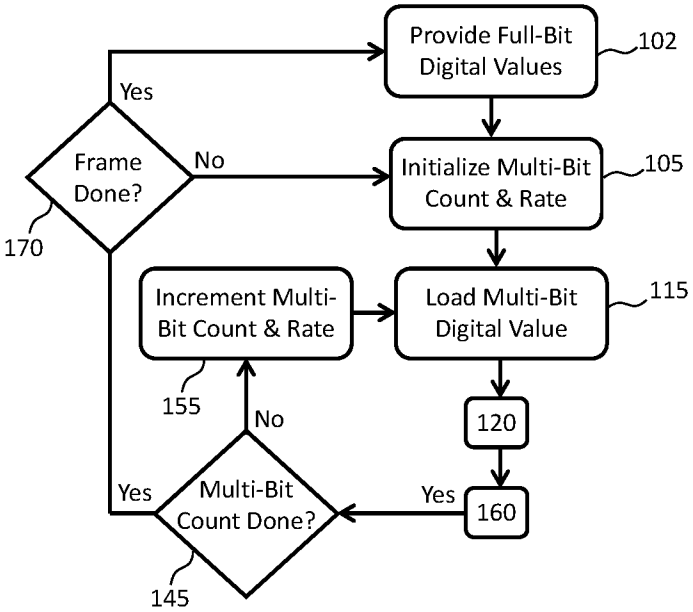

Referring to FIG. 8, in a method of the present invention, an array of full-bit digital values are provided, for example to the system controller 40 in step 102. The full-bit digital values can be pixel values, as indicated in FIG. 7 but as in FIG. 7 can be other values and are not necessarily pixel values. The number of multi-bit values is determined and the first multi-bit values and corresponding clock rate are initialized in step 105 and loaded into the elements 20 in step 115. The process of FIG. 7 then proceeds (pulse-width-modulation control is provided to the output device 27 for the current multi-bit digital value). When it is concluded, a test is performed to determine whether other multi-bit digital values are to be processed in step 145. If so, the next set of multi-bit digital values and corresponding clock rates are calculated or provided in step 155 and then initialized or loaded into the elements 20 in step 115 and the process repeats until all of the multi-bit digital values comprising the full-bit digital value are operated. The frame status is checked in step 170 and if the frame is not done the process repeats with step 105. If the frame is done, new full-bit digital values are provided in step 102.

Thus, in a method of the present invention, an array of full-bit digital values is provided, each full-bit digital value including at least first and second multi-bit digital values. Each element 20 of the array of elements 20 is loaded with the first multi-bit digital value of the array of full-bit digital values and a first timing signal provided to each element 20. The timing signal and the first multi-bit digital value are combined to provide a control signal in each element 20, the control signal responsive to the value of the first multi-bit digital value, and the output device of each element 20 is driven in response to the control signal. Each element 20 of the array of elements 20 is loaded with the second multi-bit digital value of the array of full-bit digital values and a second timing signal provided to each element 20. The second timing signal and the second multi-bit digital value are combined to provide a control signal in each element 20, the control signal responsive to the value of the second multi-bit digital value, and the output device 27 of each element 20 is driven in response to the control signal.

The first and second timing signals can be the same timing signal and the different clock signal rates corresponding to the different first and second multi-bit digital values formed in the element 20 or, alternatively, different clock signal rates corresponding to the different first and second multi-bit digital values formed in the element 20 can be provided by the system controller 40, for example, with the timing circuit 46.

Figure 6:
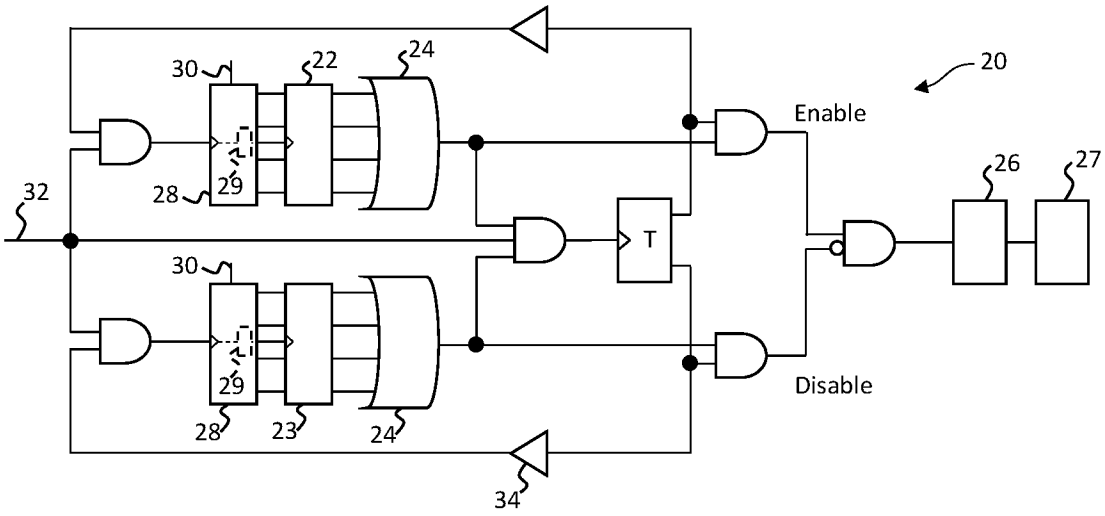
FIG. 6 is a schematic diagram of an alternate element of the embodiment of FIG. 1.

The circuit of FIG. 2 will enable the output device 27 for an uninterrupted period of time corresponding to the value loaded into the down counter 22. After the down counter 22 has reached zero, the output device 27 will be uninterruptedly disabled for the remainder of the cycle. In an alternative embodiment, the enabled and disabled periods can be alternated, reducing the appearance of flicker for a display application of the present invention. In such an alternative embodiment and referring to FIG. 6, the down counter 22 is a first counter and the elements 20 include a second counter responsive to the timing signal. A control circuit alternates the signals from the first counter and the second counter so that the output device 27 is responsive to the alternating signal. As shown in FIG. 6, the element 20 includes two each of the digital memory 28, the down counter 22, and the OR logic circuit 24, except that the second counter is an up counter 23 while the first counter is a down counter 22 as in FIG. 2. The clock signal 32 is applied through an AND gate to a Toggle flip-flop that alternates state with each applied clock signal 32. The first state of the two states of the toggle flip-flop provides the output of the down counter 22 to the drive circuit 26 and the output device 27 (that can, for example, be the circuit shown in FIG. 2). The second state of the two states of the toggle flip-flop provides the output of the up counter 23 to the drive circuit 26 and the output device 27. The down counter 22 provides an enable signal when the down counted multi-bit digital value is non-zero; it counts the number of periods when the output device 27 should be enabled. The up counter 23 provides a disable signal when the up counted multi-bit digital value is non-zero; it counts the number of periods when the output device 27 should not be enabled. For example, for a four-bit multi-bit digital value of 12, the down counter 22 provides 12 periods when the output device 27 should be enabled and the up counter 23 provides 4 periods when the output device 27 should not be enabled. The circuit of FIG. 6 temporally intersperses the disabled periods and the enable periods.

The digital memories 28 are loaded together through the serial input 30 in response to the clock signal 32. (Loading logic is not shown but can be controlled by the logic circuit 29 in each counter.) The multi-bit digital values are then applied to the up and down counters 23, 22 using the logic circuit 29. Digital circuits for controlling serial shift registers, loading counters, and providing clock signals can be made using convention Boolean logic and available integrated circuit modules. Once the output of the up and down counters 23, 22 are combined through the respective OR logic circuit 24, operation of the output device 27 can begin. If both the up and down counters 23, 22 have a non-zero value, the Toggle flip-flop will respond to the clock signal 32 and alternately provide a signal to the AND gates on the inputs applied to the counters. If the Q output of the Toggle flip flop is positive and the down counter 22 is clocked, its value is decremented and the Toggle flip-flop changes state to enable the clock input to the up counter. The next clock signal 32 will increment the up counter 23 and switch the Toggle state again. Thus, the up and down counters 23, 22 are alternately controlled by the Toggle flip-flop as long as they have non-zero contents. The delay circuits 25 prevent race conditions and ensure that the changes in Toggle flip-flop state do not inadvertently clock the up or down counters 23, 22. (Other logic designs can also prevent race conditions.) Once either of the up or down counters 23, 22 has a zero value, the Toggle flip-flop state is fixed so that the other counter is selected and responds to each clock signal 32. The up counter 23 counts up to the maximum value of the counter and then once more until it is at zero and then no longer responds to further clock signals 32. The down counter 22 counts down until it is at zero and then no longer responds to further clock signals 32. The Toggle flip-flop Q output (corresponding to the down counter state) is combined with the output of the down counter OR logic circuit 24 to provide an Enable signal for the output device 27. The Toggle flip-flop QNOT output (inverse of output Q and corresponding to the up counter state) is combined with the output of the up counter OR logic circuit 24 to provide a disable signal for the output device 27. Thus, as long as the Toggle flip-flop is alternating states and the up and down counters 23, 22 are non-zero, the output device 27 will alternate between an on and off state. Once one of the up or down counters 23, 22 is at zero, the Toggle flip-flop state is fixed. Since the Enable and Disable signals are mutually exclusive, in an embodiment it is not necessary to produce both, but they are both provided for clarity of exposition. The logic circuits of FIG. 6 are provided to demonstrate the concept of alternating enable and disable signals provided to the output device 27 and other circuit designs are possible and can be preferred.

The circuit embodiments of FIGS. 2 and 6 are exemplary and not limiting. Other circuit designs can implement the functions described and are included as part of the present invention.

The present invention can be made using conventional integrated circuit and printed circuit board materials and tools. Alternatively, some or all of the elements 20 can be provided in one or more chiplets 21, integrated circuits, or discrete parts some or all of which can be disposed on the system substrate 82 using micro-transfer printing techniques. In another embodiment, the one or more chiplets 21, integrated circuits, or discrete parts can be micro-transfer printed onto a module substrate and electrically interconnected on the module substrate. The module substrate can then be disposed onto the system substrate 82, either by conventional means or by micro-transfer printing, and electrically interconnected to make the distributed pulse-width modulation system 10 of the present invention. The chiplets 21 or integrated circuits can be supplied as bare die or unpackaged integrated circuits suitable for micro-transfer printing from a source wafer, such as a semiconductor wafer. Output devices 27 (e.g., light emitters such as LEDs) can be provided on a different semiconductor wafer and transferred to a common substrate with the circuit components (for example CMOS on silicon) providing some or all of the elements 20 to provide a heterogeneous structure. Electrical interconnections can be made using conventional photolithographic methods.

The system controller 40 can be one or more integrated circuits and can, for example, include an image frame store, digital logic, input and output data signal circuits, and input and output control signal circuits such as communication circuits 44, control circuits, and a clock signal 32 (e.g., as part of the timing circuit 46). The communication circuit 44 can drive row lines 84 and column lines 86 to provide sequential rows of multi-bit digital values to corresponding selected rows of elements 20. The system controller 40 can include an image frame store memory for storing digital pixel and calibration values. The system controller 40 can have a display controller substrate separate and distinct from the system substrate 82 that is mounted on the system substrate 82 or is separate from the system substrate 82 (as shown in FIG. 1) and connected to it by a wire bus 60, for example with ribbon cables, flex connectors, or the like.

In various embodiments of the present invention, the digital memory 28 is a multi-bit memory with various numbers of bits.

The elements 20 and the light emitters can be made in one or more integrated circuits having separate, independent, and distinct substrates from the system substrate 82. The elements 20 can be or include one or more chiplets 21: small, unpackaged integrated circuits such as unpackaged dies interconnected with wires connected to contact pads on the chiplets. The chiplets can be disposed on an independent substrate, such as the system substrate 82. In an embodiment, the chiplets are made in or on a semiconductor wafer and have a semiconductor substrate. The system substrate 82 or a module substrate can include glass, resin, polymer, plastic, or metal. Alternatively, the module substrate is a semiconductor substrate and the digital memory 28 or the drive circuit 26 are formed in or on and are native to the module substrate. The output devices 27 and portions of the circuit of the elements 20 can be disposed on the module substrate to form a heterogeneous module. The module is typically much smaller than the system substrate 82. Semiconductor materials (for example silicon or GaN) and processes for making small integrated circuits are well known in the integrated circuit arts. Likewise, backplane substrates and means for interconnecting integrated circuit elements on the backplane are well known in the printed circuit board arts. The chiplets can be applied to the display substrate 50 or to the module substrate using micro transfer printing.

The chiplets or modules can have an area of 50 square microns, 100 square microns, 500 square microns, or 1 square mm and can be only a few microns thick, for example 5 microns, 10 microns, 20 microns, or 50 microns thick.

In one method of the present invention, the elements 20 (or portions thereof) or the light emitters are disposed on the system substrate 82 by micro transfer printing. In another method, the elements 20 (or portions thereof) or the light emitters are disposed on the module substrate to form a heterogeneous module and the modules are disposed on the system substrate 82 using compound micro assembly structures and methods, for example, as described in U.S. patent application Ser. No. 14/822,868 filed Aug. 10, 2015, entitled Compound Micro-Assembly Strategies and Devices. However, since the modules are larger than the chiplets or light emitters, in another method of the present invention, the modules are disposed on the system substrate 82 using pick-and-place methods found in the printed-circuit board industry, for example, using vacuum grippers. The modules can be interconnected with the system substrate 82 using photolithographic methods and materials or printed circuit board methods and materials.

In useful embodiments, the system substrate 82 includes material, for example glass or plastic, different from a material in an integrated-circuit substrate, for example, a semiconductor material such as silicon or GaN. The light emitters can be formed separately on separate semiconductor substrates, assembled onto the module substrates and then the assembled unit is located on the surface of the system substrate 82. This arrangement has the advantage that the elements 20 can be separately tested on the module substrate and the modules accepted, repaired, or discarded before the module is located on the system substrate 82, thus improving yields and reducing costs.

In an embodiment, the drive circuits 26 drive the output devices 27 (e.g., 50R, 50G, 50B) with a current-controlled drive signal. The drive circuits 26 can convert a multi-bit digital value such as a pixel value to a current drive signal, thus forming a bit-to-current converter. Current-drive circuits, such as current replicators, can be controlled with a pulse-width modulation scheme whose pulse width is determined by the multi-bit digital value. A separate drive circuit 26 can be provided for each light emitter, or a common drive circuit 26, or a drive circuit 26 with some common components can be used to drive the light emitters in response to the multi-bit digital values stored in the digital memory 28. Power connections, ground connections, and clock signal connections can also be included in the elements 20.

In embodiments of the present invention, providing the system controller 40 and the elements 20 can include forming conductive wires (e.g., row lines 84 and column lines 86) on the system substrate 82 or module substrate by using photolithographic and display substrate processing techniques, for example photolithographic processes employing metal or metal oxide deposition using evaporation or sputtering, curable resin coatings (e.g. SU8), positive or negative photo-resist coating, radiation (e.g. ultraviolet radiation) exposure through a patterned mask, and etching methods to form patterned metal structures, vias, insulating layers, and electrical interconnections. Inkjet and screen-printing deposition processes and materials can be used to form patterned conductors or other electrical elements. The electrical interconnections, or wires, can be fine interconnections, for example, having a width of less than 50 microns, less than 20 microns, less than 10 microns, less than five microns, less than two microns, or less than one micron. Such fine interconnections are useful for interconnecting chiplets, for example as bare dies with contact pads and used with the module substrates. Alternatively, wires can include one or more crude lithography interconnections having a width from 2 μm to 2 mm, wherein each crude lithography interconnection electrically connects the modules to the system substrate 82.

In an embodiment, the red, green, and blue light emitters 50R, 50G, 50B (e.g. micro-LEDs) are micro transfer printed to the module substrates or the system substrate 82 in one or more transfers. For a discussion of micro-transfer printing techniques, see U.S. Pat. Nos. 8,722,458, 7,622,367 and 8,506,867, each of which is hereby incorporated in its entirety by reference. The transferred light emitters are then interconnected, for example with conductive wires and optionally including connection pads and other electrical connection structures, to enable the system controller 40 to electrically interact with the light emitters to emit light in the digital-drive distributed pulse-width modulation system 10 of the present invention. In an alternative process, the transfer of the light emitters is performed before or after all of the conductive wires are in place. Thus, in embodiments, the construction of the conductive wires can be performed before the light emitters are printed or after the light emitters are printed or both. In an embodiment, the system controller 40 is externally located (for example on a separate printed circuit board substrate) and electrically connected to the conductive wires using connectors, ribbon cables, or the like comprising the bus 60. Alternatively, the system controller 40 is affixed to the system substrate 82 outside the display area, for example using surface mount and soldering technology, and electrically connected to the conductive wires using wires and buses formed on the system substrate 82.

In an embodiment of the present invention, an array of elements 20 (e.g., as in FIG. 1) can include 40,000, 62,500, 100,000, 500,000, one million, two million, three million, six million or more display pixels 20, for example for a quarter VGA, VGA, HD, or 4k display having various resolutions. In an embodiment of the present invention, the light emitters can be considered integrated circuits, since they are formed in a substrate, for example a wafer substrate, using integrated-circuit processes.

The system substrate 82 usefully has two opposing smooth sides suitable for material deposition, photolithographic processing, or micro-transfer printing of micro-LEDs. The system substrate 82 can have a size of a conventional display, for example, a rectangle with a diagonal of a few centimeters to one or more meters. The system substrate 82 can include polymer, plastic, resin, polyimide, PEN, PET, metal, metal foil, glass, a semiconductor, or sapphire and have a transparency greater than or equal to 50%, 80%, 90%, or 95% for visible light. In some embodiments of the present invention, the light emitters emit light through the system substrate 82. In other embodiments, the light emitters emit light in a direction opposite the system substrate 82. The system substrate 82 can have a thickness from 5 to 10 microns, 10 to 50 microns, 50 to 100 microns, 100 to 200 microns, 200 to 500 microns, 500 microns to 0.5 mm, 0.5 to 1 mm, 1 mm to 5 mm, 5 mm to 10 mm, or 10 mm to 20 mm. According to embodiments of the present invention, the system substrate 82 can include layers formed on an underlying structure or substrate, for example, a rigid or flexible glass or plastic substrate.

In an embodiment, the system substrate 82 can have a single, connected, contiguous system substrate area that includes the elements 20 and the output devices 27 each have a functional area. The combined functional area of the plurality of output devices 27 is less than or equal to one-quarter of the contiguous system substrate area. In further embodiments, the combined functional areas of the plurality of output devices 27 is less than or equal to one eighth, one tenth, one twentieth, one fiftieth, one hundredth, one five-hundredth, one thousandth, one two-thousandth, or one ten-thousandth of the contiguous system substrate area. The functional areas of the output devices 27 can be only a portion of the element 20 or output device 27. In a typical light-emitting diode, for example, not all of the semiconductor material in the light-emitting diode necessarily emits light. Therefore, in another embodiment, the output devices 27 occupies less than one quarter of the system substrate area.

In an embodiment of the present invention, the output devices 27 are micro-light-emitting diodes (micro-LEDs), for example having light-emissive areas of less than 10, 20, 50, or 100 square microns. In other embodiments, the light emitters have physical dimensions that are less than 100 μm, for example having a width from 2 to 5 μm, 5 to 10 μm, 10 to 20 μm, or 20 to 50 μm, having a length from 2 to 5 μm, 5 to 10 μm, 10 to 20 μm, or 20 to 50 μm, or having a height from 2 to 5 μm, 4 to 10 μm, 10 to 20 μm, or 20 to 50 μm. The light emitters can have a size of one square micron to 500 square microns. Such micro-LEDs have the advantage of a small light-emissive area compared to their brightness as well as color purity providing highly saturated display colors and a substantially Lambertian emission providing a wide viewing angle.

According to various embodiments, the digital-drive distributed pulse-width modulation system 10, for example, as used in a digital display of the present invention, includes a variety of designs having a variety of resolutions, light emitter sizes, and displays having a range of display substrate areas. For example, display substrate areas ranging from 1 cm by 1 cm to 10 m by 10 m in size are contemplated. In general, larger light emitters are most useful, but are not limited to, larger display substrate areas. The resolution of light emitters over a display substrate can also vary, for example, from 50 light emitters per inch to hundreds of light emitters per inch, or even thousands of light emitters per inch. For example, a three-color display can have one thousand 10μ×10μ light emitters per inch (on a 25-micron pitch). Thus, the present invention has application in both low-resolution and very high-resolution displays. An approximately one-inch 128-by-128 pixel display having 3.5 micron by 10-micron emitters has been constructed and successfully operated as described in U.S. patent application Ser. No. 14/743,981 filed Jun. 18, 2015, entitled Micro Assembled LED Displays and Lighting Elements.

As shown in FIG. 1, the elements 20 form a regular array on the system substrate 82. Alternatively, at least some of the elements 20 have an irregular arrangement on the system substrate 82.

In an embodiment, the chiplets 21 are formed in substrates or on supports separate from the system substrate 82. For example, the output devices 27 are separately formed in a semiconductor wafer. The output devices 27 are then removed from the wafer and transferred, for example using micro transfer printing, to the system substrate 82 or module substrate. This arrangement has the advantage of using a crystalline semiconductor substrate that provides higher-performance integrated circuit components than can be made in the amorphous or polysilicon semiconductor available on a large substrate such as the system substrate 82.

By employing a multi-step transfer or assembly process, increased yields are achieved and thus reduced costs for the digital-drive distributed pulse-width modulation system 10 of the present invention. Additional details useful in understanding and performing aspects of the present invention are described in U.S. patent application Ser. No. 14/743,981 filed Jun. 18, 2015, entitled Micro Assembled LED Displays and Lighting Elements.

As is understood by those skilled in the art, the terms "over", "under", "above", "below", "beneath", and "on" are relative terms and can be interchanged in reference to different orientations of the layers, elements, and substrates included in the present invention. For example, a first layer on a second layer, in some embodiments means a first layer directly on and in contact with a second layer. In other embodiments, a first layer on a second layer can include another layer there between.

Having described certain embodiments, it will now become apparent to one of skill in the art that other embodiments incorporating the concepts of the disclosure may be used. Therefore, the invention should not be limited to the described embodiments, but rather should be limited only by the spirit and scope of the following claims.

Throughout the description, where apparatus and systems are described as having, including, or comprising specific components, or where processes and methods are described as having, including, or comprising specific steps, it is contemplated that, additionally, there are apparatus, and systems of the disclosed technology that consist essentially of, or consist of, the recited components, and that there are processes and methods according to the disclosed technology that consist essentially of, or consist of, the recited processing steps.

It should be understood that the order of steps or order for performing certain action is immaterial so long as the disclosed technology remains operable. Moreover, two or more steps or actions in some circumstances can be conducted simultaneously. The invention has been described in detail with particular reference to certain embodiments thereof, but it will be understood that variations and modifications can be effected within the spirit and scope of the invention.

PARTS LIST

B0 multi-bit digital value bit 0
B1 multi-bit digital value bit 1
B2 multi-bit digital value bit 2
B3 multi-bit digital value bit 3
10 pulse-width-modulation system
20 pulse-width-modulation element
21 chiplet
22 down counter
23 up counter
24 OR logic circuit
25 enable signal
26 drive circuit
27 output device
28 digital memory/serial shift register
29 logic circuit
30 serial input
32 clock signal
34 delay circuit
40 system controller
42 memory
44 communication circuit
46 timing circuit
50R red light emitter
50G green light emitter
50B blue light emitter
60 bus
70 full-color pixel
82 system substrate
84 row lines
86 column lines
100 provide pixel values step
102 provide full-bit digital values step
105 set multi-bit count and rate to 0 step
110 load pixel values step
115 load multi-bit pixel value step
120 set counter=pixel value step
130 test counter=0 step
140 decrement counter step
145 test multi-bit count done step
150 enable output step
155 increment multi-bit count and rate step
160 test cycle done step
170 test frame done step

What is claimed:

1. A distributed pulse-width modulation system, comprising:

an array of pulse-width modulation elements, each element comprising:

a digital memory for storing a multi-bit digital value, and a drive circuit that drives an output device in response to the multi-bit digital value stored in the digital memory; and a system controller comprising:

a memory for storing a multi-bit digital value for each element, and a communication circuit for communicating each multi-bit digital value to each corresponding pulse-width modulation element, wherein the system controller comprises a timing circuit for providing timing signals to each element, wherein the timing signals control the rate at which the output device is driven in response to the multi-bit digital value stored in the digital memory, wherein the system controller comprises a memory for storing a full-bit digital value for each element, wherein the full-bit digital value comprises a plurality of multi-bit digital values, and the communication circuit communicates each multi-bit digital value of the full-bit digital value to each corresponding element sequentially, wherein the timing circuit, in response to the system controller, provides a timing signal with a first period for a first multi-bit digital value and provides a timing signal with a second period different from the first period for a second multi-bit digital value, and wherein the first multi-bit digital value represents the lower bits of the full-bit digital value and the second multi-bit digital value represents the upper bits of the full-bit digital value and the first and second periods are related by the relative value of the lower bits and the upper bits in the full-bit digital value.

2. The system of claim 1, wherein the elements each comprise a counter that is responsive to the timing signal and the output device is responsive to the counter.

3. The system of claim 2, wherein the counter is a first counter and the system comprises:

a second counter responsive to the timing signal; and a control circuit that alternates the signals from the first counter and the second counter, wherein the output device is responsive to the alternating signal.

4. The system of claim 1, wherein the system is a display system, the elements are pixel elements, the multi-bit digital value is a pixel value specifying light output, and the output device outputs light.

5. The system of claim 1, wherein the elements form an array of elements arranged in rows and columns.

6. The system of claim 5, wherein the system controller is an active-matrix controller for the array of elements.

7. The system of claim 1, wherein the drive circuit, in response to the pulse-width modulation element, sequentially provides a voltage or a current corresponding to the value of each bit of the multi-bit digital value.

8. The system of claim 7, wherein the drive circuit, in response to the pulse-width modulation element, supplies a constant current or voltage to the output device for a time period corresponding to the value of each bit of the multi-bit digital value.

9. The system of claim 8, wherein the system controller comprises a timing circuit for providing timing signals to each element, wherein the time period is formed with a counter controlled by the timing signal.

10. The system of claim 1, wherein the output device is a light-emitting diode.

11. The system of claim 1, wherein the display system comprises a plurality of light-emitting diodes and each output device is a light-emitting diode of the plurality of light-emitting diodes.

12. A method of controlling a distributed pulse-width modulation system according to claim 1, comprising:

providing an array of full-bit digital values, each full-bit digital value comprising a first multi-bit digital value and a second multi-bit digital value;

loading each element of the array of elements with the first multi-bit digital value of the array of full-bit digital values;

providing a first timing signal to each element;

combining the first timing signal and the first multi-bit digital value to provide a control signal in each element, the control signal responsive to the value of the first multi-bit digital value; and driving the output device of each element in response to the control signal;

loading each element of the array of elements with the second multi-bit digital value of the array of full-bit digital values;

providing a second timing signal to each element;

combining the second timing signal and the second multi-bit digital value to provide a control signal in each element, the control signal responsive to the value of the second multi-bit digital value; and driving the output device of each element in response to the control signal.

13. The method of claim 12, wherein the rate of the first timing signal and the rate of the second timing signal are related by the relative value of the lower bits and the upper bits in the full-bit digital value.

14. The method of claim 12, wherein the timing signal for different elements are relatively out of phase.

15. A distributed pulse-width modulation system, comprising:

an array of pulse-width modulation elements, each element comprising:

a digital memory for storing a multi-bit digital value, a drive circuit that drives an output device in response to the multi-bit digital value stored in the digital memory, a first counter and a second counter, and a control circuit that alternates signals from the first counter and the second counter, wherein the output device is responsive to the alternating signals;

a system controller comprising:

a memory for storing a multi-bit digital value for each element, and a communication circuit for communicating each multi-bit digital value to each corresponding pulse-width modulation element; and a timing circuit for providing timing signals to each element, wherein the timing signals control the rate at which the output device is driven in response to the multi-bit digital value stored in the digital memory, wherein the first and second counters in each element are responsive to the timing signal.

* * * * *